United States Patent [19]

Maehara

[11] 4,141,942

[45] Feb. 27, 1979

[54] PROCESS FOR PREPARING FIBROUS MATERIALS BY WET METHOD

[75] Inventor: Junichiro Maehara, Sodegaura, Japan

[73] Assignee: Idemitsu Kosan Co., Ltd., Tokyo, Japan

[21] Appl. No.: 903,572

[22] Filed: May 8, 1978

Related U.S. Application Data

[63] Continuation of Ser. No. 689,801, May 25, 1976, abandoned.

[30] Foreign Application Priority Data

Jun. 4, 1975 [JP] Japan ..... 50-67400
Jun. 23, 1975 [JP] Japan ..... 50-77289

[51] Int. Cl.[2] ..... B22D 23/08; D01F 6/00

[52] U.S. Cl. ..... 264/9; 264/103; 264/140; 264/180; 264/182; 264/184; 264/187; 264/200; 264/202

[58] Field of Search ..... 425/68, 86; 264/180, 264/140, 168, 200, 208, 130, 143, 183, 184, 188, 202, 103, 9, 187; 210/500 M; 260/2.5 M

[56] References Cited

U.S. PATENT DOCUMENTS

| | | | |
|---|---|---|---|
| 1,119,155 | 12/1914 | Hartogs | 264/130 |
| 1,910,879 | 5/1933 | Bernstein | 425/68 |
| 2,004,272 | 6/1935 | Dreyfus | 264/190 |
| 2,004,273 | 6/1935 | Dreyfus | 264/208 |
| 2,199,882 | 5/1940 | Inokuchi et al. | 264/180 |
| 2,708,617 | 5/1955 | Magat et al. | 425/68 |
| 3,068,527 | 12/1962 | Morgan | 264/143 |
| 3,674,628 | 7/1972 | Fabre | 264/182 |
| 3,888,771 | 6/1975 | Isuge | 264/41 |
| 3,930,105 | 12/1975 | Christen et al. | 264/41 |
| 3,975,478 | 8/1972 | Leonard | 264/41 |
| 4,026,978 | 5/1977 | Mungle et al. | 264/41 |

*Primary Examiner*—Jay H. Woo
*Attorney, Agent, or Firm*—Flynn & Frishauf

[57] ABSTRACT

This invention relates to a process for preparing fibrous materials by wet method. Fibrous materials with excellent properties can be obtained by feeding the starting solution to the interface area of two phases of the coagulation bath.

18 Claims, No Drawings

PROCESS FOR PREPARING FIBROUS MATERIALS BY WET METHOD

This is a continuation of application Ser. No. 689,801 filed May 25, 1976 now abandoned.

BACKGROUND OF THE INVENTION (a) Field of the Invention

The present invention relates to a process for preparing fibrous materials by wet method, using a coagulation bath consisting of two kinds of liquid which form two phases.

(b) Description of the Prior Art

In the process for preparing fibrous materials by wet method, starting materials for fibrous materials generally precipitate as clumps without sufficient gelation, when the coagulation ability of the coagulation bath is poor and the specific gravity of the coagulation bath is substantially smaller than that of the starting solution for fibrous materials.

On the other hand, when the specific gravity of the coagulation bath is substantially higher than that of the starting solution for fibrous materials, the starting solution floats to the surface without gelation.

In order to overcome these difficulties, usage of the coagulation bath of sufficient coagulation ability might be taken into consideration. However, usage of such coagulant causes rapid gelation of only external parts of fibrous materials and produces hard and fragile fibrous materials with cavities inside, and therefore such process has not been practical.

SUMMARY OF THE INVENTION

An object of this invention is to provide a process for preparing such fibrous materials as filaments and fibrils by wet method. According to the invention, the starting solution for fibrous materials is fed to an interface area of two liquid phases in a coagulation bath. At least one of the two liquids has a sufficient coagulating ability to make the starting solution into a gel.

According to the present invention, such phenomena as sedimentation of flotation of the starting solution can be prevented.

DETAILED DESCRIPTION OF THIS INVENTION

The present invention provides a process for preparing fibrous materials by wet method, which comprises feeding a starting solution for fibrous materials to an interface area of two liquid phases in a coagulation bath, where the two liquid phases are not miscible with each other and at least one of the two has a sufficient coagulating ability to make the starting solution into a gel.

According to the present invention, such phenomena as sedimentation or flotation of the starting solution can be prevented and moreover this invention has advantages that fragmentation of premature gelated materials (especially filaments) and damage on appearance of fibrous materials due to dispersion of fine gelated precipitates, which did not participate to form fibrous materials, into the coagulation bath can be also prevented. Furthermore, in the present invention, by employing a specific coagulant, which tends easily to form fine fibrils having nothing to do with ability of coagulation, fibrils which have developed very fine linear structure can be prepared by standing them after the addition of the prescribed amounts of the starting solution for fibrous materials.

Examples of a starting solution for fibrous materials are an aqueous solution of cellulose sodium xanthogenate for rayon fibrous materials; acetone or methylene chloride solution of cellulose acetate for cuprammonium rayon fibrous materials; rhodanate, nitrate, N,N-dimethylformamide, N,N-dimethylacetoamide, dimethylsulfoxide or acetone solution of polyacrylonitrile for acrylic fibrous materials; aqueous, alcohol or urea solution of polyvinyl alcohol for vinylon fibrous materials; acetone-carbon disulfide or acetone-benzene solution of polyvinyl chloride for polyvinyl chloride fibrous materials; N,N-dimethylformamide, N,N-dimethyl acetoamide or dimethylsulfoxide solution of polyurethane for polyurethane fibrous materials; aqueous alkaline or dimethylsulfoxide solution of soy casein, milk casein or yeast protein for proteinous fibrous materials; and methylene dichloride solution of poly (L-glutamate-γ-methyl) or aqueous solution of poly (L-sodium glutamate) for polyamino acid fibrous materials. Moreover, mixtures of the above described starting solutions consisting of two or more kinds of components can also be employed in the present invention. Furthermore, the starting solution of natural fiber being grafted with a polymeric substance or a synthetic graft-copolymer or block-copolymer can also be employed for preparation of fibrous materials of this invention.

As a coagulation bath in the present invention, there is used a mixed system of two kinds of liquids that are not miscible with each other and form an interface area due to separation into two phases. One of the two is required to possess sufficient coagulation ability to cause gelation of the starting solution for fibrous materials. Furthermore, it is possible to add additives for increasing or decreasing coagulation ability, solvents for adjusting specific gravity or soluble materials to the above coagulation bath as required.

On forming a coagulation bath, it is possible to make either or both the upper or lower phase as the coagulation phase.

Generally, as a measure of coagulation ability, it is common to express the amount of coagulation agent required for forming white precipitates by dropwise addition of said coagulation agent to the starting solution for fibrous materials, by a so-called "coagulation value". The smaller the coagulation value, the greater the coagulation ability, and the value will vary depending on the combination of the starting material, solvent and coagulant.

Sufficient coagulation ability for causing gelation described in the present invention means a coagulation value of below 30, preferably below 20. That is, in order to achieve the object of preventing phenomena of sedimentation or floating upon wet method of fibrous materials in the present invention, it is sufficient that either the upper or lower phase have a coagulation value of below 30, preferably below 20. However, in order to achieve other objects of the present invention, that is rapid spinning of filaments with excellent transparency and strength, and rapid formation of fibrils with well developed fine fibrils and strength, it is advantageous to use a combination of the upper and lower phases with remarkably different coagulation values, for example one coagulation value is more than 30 and the other value is below 10.

As described in the foregoing sections, phenomena of sedimantation or flotation of viscous fibers or clumps in the coagulation bath in the wet method occurs in the early stage where gelation of the starting solution for fibrous materials has not progressed as yet, and thus those phenomena occur as a result of a relationship between specific gravity of the starting solution for fibrous materials and that of the coagulation solution. That is, in general in a region where the specific gravity of the coagulation solution is smaller than that of the starting solution for fibrous materials, sedimentation will occur and in a region where the specific gravity of the coagulation solution is greater than that of the starting solution for fibrous materials, flotation will occur, although these phenomena may vary depending on degree of coagulation ability in some parts. Therefore, in order to prevent sedimentation or flotation, it is necessary to employ a coagulation bath consisting of a combination of an upper phase having a specific gravity ($G_1$) smaller than that ($G_0$) of the starting solution for fibrous materials and a lower phase having a specific gravity ($G_2$) greater than $G_0$. However, since kinetic factors, i.e. diffusion of coagulant into a formed fibrous material (filament or fibril) and diffusion of solvent of said formed fibrous material into the coagulation solution, are related to the gelation, coagulation ability of the coagulation solution affects the practical process for forming of fibrous materials. Generally, in a coagulation solution with greater coagulation ability such as water or formic acid, diffusion of the coagulation solution into a formed fibrous material occurs predominantly, while in a coagulation solution with a comparatively smaller coagulation ability such as higher aliphatic alcohols, polyalcohols or aromatic hydrocarbons, diffusion of solvent of a formed fibrous material into the coagulation solution occurs predominantly. Therefore, even when $G_1$ is greater than $G_0$, rapid gelation of a formed fibrous material that is about to float will occur and at the same time the coagulant in an upper phase with greater coagulation ability predominantly diffuses into the formed fibril if coagulation ability is sufficiently high. And thus the specific gravity of the formed fibril or filament increases quickly to that of the upper phase; subsequently a desired spinning can be attained while preventing flotation.

Even when $G_2$ is smaller than $G_0$, the phenomenon of sedimentation will be prevented for reasons similar to those described above, if the coagulation ability of the lower phase is sufficiently high.

Accordingly, in the present invention it is necessary to select each component of the coagulation solution to satisfy a prescribed relationship of $G_0$ and $G_1$, and of $G_0$ and $G_2$. In the following sections, the relationship between specific gravity and coagulation ability will be described. $P_1$ and $P_2$ indicate coagulation values for upper phase and lower phase, respectively.

(A) $G_2 > G_1 \geqq G_0$

In this case, $P_1 \leqq 20 \leqq P_2$, preferably $P_1 \leqq 10$ and $P_2 \geqq 30$ must be satisfied. Examples of a combination to satisfy the above relationship are as follows: a combination of such an upper phase as a ketone (acetone, methylethyl ketone, diethyl ketone, etc.); tetrahydrofuran; organic acid (formic acid, acetic acid, etc.); aldehyde (formaldehyde, acetoaldehyde, etc.); and such a lower phase as glycerin or a derivative thereof, and a starting solution for fibrous materials such as a proteinous solution of casein, yeast protein, etc., solution of vinylon fiber or solution of polyvinyl fiber; and a combination of an upper phase such as water, such lower phase as a halogenated benzene (monochlorobenzene, o-, m- or p-dichlorobenzene, 1,2,4-trichlorobenzene, etc.), and a starting solution for fibrous materials such as an acrylic solution.

(B) $G_0 \geqq G_2 > G_1$

In this case, $P_2 \leqq 20 \leqq P_1$, preferably $P_2 \leqq 10$ and $P_1 \geqq 30$ must be satisfied. As examples of a combination to satisfy this relationship, a combination of an aliphatic hydrocarbon such as n-heptane, isopentane, etc.; liquid paraffin; ligroin, kerosene etc.; an organic acid ester such as methyl acetate, ethyl acetate, butyl acetate, dibutyl phthalate, etc.; and an aromatic hydrocarbon such as benzene, toluene, o-xylene, p-xylene, etc., as the upper phase and water as the lower phase, and a solution of viscose rayon or rayon, cuprammonium rayon, acrylate or vinylon as the starting solution for fibrous materials. Other examples are as follows: a combination of glycerin or a derivative thereof as the upper phase, a halogenated organic acid such as monochloroacetic acid, dichloroacetic acid or trifluoroacetic acid as the lower phase, and a polyamino acid solution as the starting solution for fibrous materials; a combination of an organic acid ester such as methyl acetate, ethyl acetate, butyl acetate, dibutyl phthalate, etc. an aromatic hydrocarbon such as benzene, toluene, o- or p-xylene as the upper phase, a diamine such as hydrazine, ethylene diamine, hexamethylene diamine, etc., as the lower phase, and a polyurethane solution or polyurethane copolymer such as protein grafted with polyurethane as the starting solution for fibrous materials.

(C) $G_2 \geqq G_0 \geqq G_1$

In this case, $P_1 \leqq 20 \leqq P_2$, preferably $P_1 \leqq 10$ and $P_2 \geqq 30$, or $P_2 \leqq 20 \leqq P_1$, preferably $P_2 \leqq 10$ and $P_1 \geqq 30$ must be satisfied. Examples satisfying this relationship are shown in (A) and (B).

In this invention, it is necessary to feed the starting solution for fibrous materials into the interface of a biphasic coagulation bath. As a spinning nozzle for preparation of filaments, conventional nozzles can be used when they are below 30 mm, preferably below 20 mm, in diameter of area for spinning nozzles. Preferable spinning nozzles are those distributing strips parallel to the interface of the coagulation solution, and their shorter side is preferably below 30 mm, particularly preferably below 20 mm in width.

Upon reeling of filaments, it is advantageous to reel filaments in the direction of reeling as an axis. In the spinning procedure of the present invention, post-treatments such as drying, heat-treatment, elongation, etc., can be applied as in the conventional wet spinning. Furthermore, conditioning of filaments can be made using a mixture solution, the composition of which may differ from that of the coagulation solution if desired.

Moreover, in the present invention, during feeding of the starting solution for fibrous materials to the interface area of a biphasic coagulation bath, shear force can be applied in order to obtain fibrils. As a means for applying a shear force, stirring by stirring blades or reciprocal agitation by vibration applied in parallel to the interface area of the coagulation bath can be employed. Especially, the latter is more advantageous, since the control of coagulation ability of the coagulation bath is easily attained. This shear force may vary depending on kinds of coagulation bath, characteristics of the starting solution for fibrous materials, fineness of fibrils or fiber length, etc. When practicing this invention, it can be accomplished sufficiently with low linear velocity for shearing such as from 20 cm/sec to 2 m/sec.

Fibrils prepared by the present invention are suspended exclusively in the interface of the two liquid phases and thus they are easily recovered by withdrawing the liquid near the interface. Complete splitting of yarns can be attained by agitating the solution containing fibrils, if required.

Fibrils thus recovered can be made into webs after washing and filtration as done in the conventional method. Furthermore, heat-treatment by heated roll or a heated gas and conditioning using a biphasic treating bath, the composition of which may differ from that of the coagulation bath can also be applied, if desired.

According to the method of the present invention, it is possible to select the coagulation solution widely, to prevent the phenomena of sedimentation and flotation and to recover nonfibrous gel easily. Furthermore, filaments useful for various purposes and fibrils with good quality for raw materials to make non-woven fabric goods and synthetic pulp can be prepared at rapid speed. For the foregoing reasons, the present invention is preferable as an industrial process.

The present invention is described in detail by means of the following examples and comparative examples.

EXAMPLE 1

Ten parts by weight of commercially available acrylic yarn for handicraft (Patria: extremely fine, acrylic 100%), was dissolved in 90 parts by weight of dimethylsulfoxide by stirring them at room temperature and the starting solution for spinning had a specific gravity of 1.10 and was prepared after standing for one day to remove gas.

Ethyl acetate (specific gravity; 0.90, coagulation value; 67.8) was used as the upper phase of a coagulation solution and water (specific gravity: 1.00, coagulation value: 8.3) as the lower phase, and in the interface area of the above coagulation solution (15° C.) the above starting solution was spun through a spinning nozzle consisting of 40 holes, each 0.06 mm in diameter, at 15° C. The length of the coagulation bath from the nozzle to the outlet was 170 cm.

Subsequently, the maximum reeling rate was measured by increasing the reeling rate and the feeding rate of the starting solution. Under spinning conditions, i.e., driving pressure of 15.2 kg/cm$^2$, maximum reeling rate of 42.0 m/min, draft rate of 5.9, the spinning was continued for 24 hours and stable spinning was confirmed.

Filaments thus obtained were drawn at a drawing rate of 3.6 in the second bath (94° C.) consisting of an aqueous solution of 70 weight percent of dimethylsulfoxide and then dried at 95° C. after treatment with heated steam (110° C.). By these procedures, white luster filaments of 3 denier fineness were obtained.

COMPARATIVE EXAMPLE 1

Using ethyl acetate as the coagulation solution, the same starting solution as shown in Example 1 was spun by wet method. In this case, the starting solution extruded from the spinning nozzle ran down to the bottom of the coagulation bath at the vicinity of the nozzle and solidified to form clumps. Spinning was repeated under various conditions, but the above described running down was not prevented.

COMPARATIVE EXAMPLE 2

Using only water as the coagulation solution, the same starting solution as shown in Example 1 was spun. In this case, driving pressure was 10.0 kg/cm$^2$, maximum reeling rate was 7.9 m/min and draft rate was 1.1. Filaments thus obtained were very fragile and it was very difficult to achieve continuous reeling.

EXAMPLE 2

Soy casein (3 parts by weight) was dissolved in N,N-dimethyl formamide (90 parts by weight) at 80° C. and then polyacrylonitrile (7 parts by weight) was added with stirring while cooling at the room temperature and after complete dissolution, it was cooled to 20° C. A starting solution having a specific gravity of 0.95 was obtained.

Keeping the coagulation bath at 20° C., which consisted of methyl acetate (specific gravity: 0.93, coagulation value: 40.6) as the upper phase and water (specific gravity: 1.00, coagulation value: 6.2) as the lower phase, the above described starting solution was spun in the interface area by the same method as described in Example 1.

In this case, driving pressure, maximum reeling rate and draft rate were 9.9 kg/cm$^2$, 19.0 m/min and 1.1, respectively, and filaments of good quality were obtained.

EXAMPLE 3

Ten parts by weight of commercially available Spandex fiber (Du Pont, 70 denier) were added to N,N-dimethylacetoamide (90 parts by weight) and stirred at 90° C. to make a complete solution and then let it cool to 40° C. The starting solution was thus obtained.

Keeping the coagulation bath at 20° C. which consisted of p-xylene (specific gravity: 0.86, coagulation value: 56.0) as the upper phase, and hydrazine (specific gravity: 1.04, coagulation value: 6.3) as the lower phase, the above described starting solution was spun in the interface of the coagulation bath under the following conditions: driving pressure; 14.6 kg/cm$^2$, maximum reeling rate: 24.1 m/min, and draft rate: 3.0. Continueous spinning was easily made under the above conditions.

When only p-xylene was used as the coagulation bath, phenomenon of "running down" occurred and the spinning was impossible.

COMPARATIVE EXAMPLE 3

Using a uniform system comprising equal amounts of hydrazine and ethylene diamine (specific gravity: 1.02, coagulation value: 23.3) as the coagulation solution, the same starting solution as described in Example 3 was spun. The starting solution extruded from the spinning nozzle floated towards the surface of the coagulation solution in the early stage where gelation had not progressed at the vicinity of the nozzle. This solution was cut into pieces and parts of this was developed as the membrane on the surface and solidified. In this case, a typical flotation was observed and the spinning was impossible.

EXAMPLE 4

Ten parts by weight of commercially available spandex fiber were dissolved in N,N-dimethyl formamide (90 parts by weight) and thus the starting solution (specific gravity: 0.94) for fibrous material was prepared.

Using a coagulation bath comprising kerosene (specific gravity: 0.87, coagulation value: 12.3) as the upper phase and a mixture consisting of equal amounts of water and dimethyl sulfoxide (specific gravity: 0.97, coagulation value: 36.0) as the lower phase, the starting solution was spun at the interface of the bath.

Satisfactory operation of continuous spinning proceeded under the conditions of driving pressure: 12.5 kg/cm$^2$, maximum reeling rate: 26.8 m/min and draft rate: 3.8.

EXAMPLE 5

Ten parts by weight of a grafted copolymer of yeast protein and polyurethane (cf. Japanese Laid Open Patent Gazette; 85210/1974) were added to 90 parts by weight of dimethyl sulfoxide and stirred at 140° C. to dissolve therein and then they were left to cool to 50° C. A starting solution with a specific gravity of 0.94 was thus obtained.

Using a coagulation bath comprising benzene (specific gravity: 0.88, coagulation value: 60.0) as the upper phase and hydrazine (specific gravity: 1.04, coagulation value: 6.6) as the lower phase, the starting solution described above was spun at the interface of the bath and satisfactory operation of continuous spinning was made under the conditions of driving pressure of 20.0 kg/cm$^2$, maximum reeling rate of 36.2 m/min and draft rate of 2.8.

EXAMPLE 6

Ten parts by weight of cellulose triacetate were added to 90 parts by weight of methylacetate and were dissolved completely at 50° C. By cooling the thus obtained solution to 15° C., a starting solution of specific gravity of 0.94 was prepared.

Using a coagulation bath consisting of butyl acetate (specific gravity: 0.88, coagulation value: 37.4) as the upper phase and a mixture of water and isopropyl alcohol (mixing ratio of 7:3 by weight, specific gravity: 0.94, coagulation value: 4.5) as the lower phase, the starting solution described above was spun at the interface of the bath and satisfactory operation of continuous spinning was made under the conditions of driving pressure of 18 kg/cm$^2$, maximum reeling rate of 38 m/min and draft rate of 4.5.

EXAMPLE 7

The starting solution of specific gravity of 1.10 was made by dissolving 10 parts by weight of polyacrylonitrile fiber (Tradename: Patria) to 90 parts by weight of dimethylsulfoxide with stirring at room temperature and allowing the solution to stand for one day to remove gas.

In a treatment tank of 100 liters content and having a length from nozzle to outlet of fibrils of 2 m, 30 liters of ethyl acetate (specific gravity: 0.90, coagulation value: 67.8) as the upper phase and 30 liters of water (specific gravity: 1.00, coagulation value: 8.3) as the lower phase, were introduced. Then the starting solution of fibrils described above was fed to the interface of the above two phases at a rate of 120 ml/min at 15° C. from the slit nozzle with 50 mm in width and 0.2 mm in interval which was equipped in the one end of the tank. At the same time, a shear force was applied at 10 mm from the tip of the nozzle by reciprocal mixing with a linear velocity of 1.6 m/sec in the direction of a right angle to the extruding starting solution and parallel to the interface of the biphasic liquid in the coagulation bath.

By the above procedure, fibrils like absorbent cotton were formed exclusively in the interface area of the two phases of the bath. These fibrils were recovered on screen meshes and were washed with water at 15° C. After being treated with steam at 110° C., they were treated with hot air at 95° C. It was noted that the fibrils thus obtained were 3 ~ 5$\mu$ in width and 10 ~ 30 mm in length.

COMPARATIVE EXAMPLE 4

Using a uniform phase consisting of an aqueous solution of 50 weight % of dimethyl sulfoxide (specific gravity: 1.05, coagulation value: 17.8) as the coagulation bath which is used in the conventional wet method for fibrillation, fibrillation of the same starting solution of Example 7 was attempted under the same conditions described in Example 7 except that the feeding rate was 120 ml/min and the linear velocity for shearing was 1.6 m/sec. However, linear and uniform fine fibrils were not obtained.

Subsequently, fibrillation was attempted at 30 ml/min and 300 ml/min feeding rates and 0.4 m/sec and 3.2 m/sec linear velocity for shearing. However, linear and uniform fine fibrils were not obtained likewise.

COMPARATIVE EXAMPLE 5

Using only ethyl acetate as the coagulation bath, fibrillation was attempted under the same conditions as in Example 7. However, the starting solution extruded from the nozzle formed a sediment towards the bottom of the bath in the vicinity of the nozzle and solidified as clumps, and some parts adhered to the stirring bar. As a result, no fibrils were obtained.

Subsequently, fibrillation was attempted by varying feeding rate of the starting solution and stirring rate. This was also unsuccessful.

COMPARATIVE EXAMPLE 6

Using water alone as the coagulation bath, fibrillation was attempted as described in Example 7. However, under the conditions of below 300 ml/min feeding rate of the starting solution and below 3.2 m/sec linear velocity for shearing, a white precipitate came out and no fibrils were obtained.

EXAMPLE 8

Milk casein (3 parts by weight) was added to 90 parts by weight of N,N-dimethyl formamide and they were stirred at 80° C. to obtain a complete solution. Then polyacrylonitrile (7 parts by weight) was added while cooling at room temperature, and after cooling to 20° C., a starting solution with a specific gravity of 0.96 was thus obtained.

Keeping a coagulation bath at 20° C., the bath comprising methyl acetate (specific gravity: 0.93, coagulation value: 40.6) as the upper phase and water as the lower phase, the starting solution described above was fed at 120 ml/min feeding rate and at 0.8 m/sec linear velocity for shearing and thus proteinous compound consisting of fine fibrils was obtained. This compound recovered after washing with water was very similar in feel to absorbent cotton.

EXAMPLE 9

Ten parts by weight of commercially available spandex fiber (Du Pont, 70 denier) were added to N,N-dimethylacetoamide (90 parts by weight) and stirred at 90° C. to form a complete solution. It was then allowed to cool to 40° C. Thus, a starting solution (specific gravity: 0.94) was prepared.

Keeping a coagulation bath at 20° C., the bath comprising p-xylene (specific gravity: 0.86, coagulation value: 56.0) as the upper phase and hydrazine (specific gravity: 1.04, coagulation value: 6.3) as the lower phase, fibrilation was made by feeding the above starting solution to the interface of the bath at 120 ml/min feeding rate and 1.6 m/sec linear velocity for shearing, and thus fibrils of fineness of 1.5 denier consisting of uniform fine fibrils were obtained.

COMPARATIVE EXAMPLE 7

Using p-xylene alone as the coagulation bath, the same starting solution as in Example 9 was processed to make fibrils under the same conditions as described in Example 9. The starting solution formed viscous clumps which formed a sediment on the bottom and solidified.

Subsequently, fibrillation was attempted under various conditions. However, successful fibrillation was not attained under the conditions of below 300 ml/min feeding rate of the starting solution and below 3.2 m/sec linear velocity for shearing.

COMPARATIVE EXAMPLE 8

Using a uniform phase system comprising hydrazine and ethylenediamine (mixing ratio: 1:1 by weight) which has a specific gravity of 1.02, and a coagulation value of 23.3, as the coagulation bath, the same starting solution as in Example 9 was processed to make fibrils. However, under conditions of feeding rate of the starting solution of below 300 ml/min and linear velocity for shearing of below 3.2 m/sec, the starting solution extruded from the nozzle formed viscous clumps at an early stage. The clumps floated to the surface of the coagulation bath, and thus fibrils were not obtained.

EXAMPLE 10

Using a two phase coagulation bath which is comprised of kerosene (specific gravity: 0.87, coagulation value: 12.3) as the upper phase and 1:1 mixture (by weight) of water and dimethylsulfoxide (specific gravity: 0.97, coagulation value: 36.0) as the lower phase, the same starting solution as shown in Example 9 was processed to make fibrils under the conditions of feeding rate of the starting solution of 120 ml/min and linear velocity for shearing of 1.6 m/sec. Fibrils of 5 ~ 6μ in width and 10 ~ 30 mm in fiber length were obtained.

EXAMPLE 11

The starting solution for fibrous material was prepared by the same way as in Example 5. Subsequently, using a coagulation bath (30° C.) comprising benzene (specific gravity: 0.88, coagulation value: 60.0) as the upper phase and hydrazine (specific gravity: 1.04, coagulation value: 6.6) as the lower phase, the above described starting solution was processed to make fibrils under the conditions of feeding rate of the starting material of 120 ml/min and linear velocity for shearing of 1.6 m/sec. A fibril complex of about 10μ in width and 10 ~ 20 mm in fiber length was obtained.

EXAMPLE 12

The same starting solution and coagulation bath as in Example 6 were prepared. Keeping the coagulation bath at 15° C., fibrillation of the above described starting solution proceeded under the condition of feeding rate of the starting solution of 60 ml/min and linear velocity for shearing of 3.2 m/sec. Fine fibrils of 3 ~ 4μ in width and 10 ~ 30 mm in fiber length were thus obtained.

What is claimed is:

1. A process for preparing a fibrous material by wet method from a starting solution for a fibrous material, which comprises:

forming a coagulation bath containing an upper liquid phase and a lower liquid phase, said liquid phases being immiscible with each other, defining an interface area with each other, and at least one of the two liquid phases having a sufficient coagulating ability to make the starting solution into a gel, feeding the starting material to said interface area in the bath, spinning the starting solution and forming the fibrous material in the course of traveling in the interface area through the coagulation bath, and reeling the formed fibrous material, the relationship between coagulating values and specific gravities of said liquid phases and the specific gravity of said starting solution being (A) $G_2 > G_1 \geqq G_0$ when $P_1 \leqq 20 \leqq P_2$, (B) $G_0 \geqq G_2 > G_1$ when $P_2 \leqq 20 \leqq P_1$, and (C) $G_2 \geqq G_0 \geqq G_1$ when $P_1 \leqq 20 \leqq P_2$ or $P_2 \leqq 20 \leqq P_1$, wherein $G_0$ is the specific gravity of the starting solution, $G_1$ is the specific gravity of the upper of said two liquid phases in said bath, $G_2$ is the specific gravity of the lower of said two liquid phases in said bath, $P_1$ is the coagulation value of said upper phase, and $P_2$ is the coagulation value of said lower phase.

2. A process according to claim 1, wherein (A) $G_2 > G_1 \geqq G_0$ when $P_1 \leqq 20 \leqq P_2$.

3. A process according to claim 1, wherein (B) $G_0 \geqq G_2 > G_1$ when $P_2 \leqq 20 \leqq P_1$.

4. A process according to claim 1, wherein (C) $G_2 \geqq G_0 \geqq G_1$ when $P_1 \leqq 20 P_2$.

5. A process according to claim 1, wherein (C) $G_2 \geqq G_0 \geqq G_1$ when $P_2 \leqq 20 \leqq P_1$.

6. The process according to claim 1, wherein reeling of the formed fiber is carried out with a reeling rate of from 19 to 42 meters per minute and a draft rate of from 1.1 to 5.9.

7. A process according to claim 1, wherein the fibrous material comprises filaments.

8. A process according to claim 1, wherein the fibrous material comprises fibrils.

9. A process according to claim 1, wherein either the upper or lower phase of the coagulation bath has a coagulation value of below 30.

10. A process according to claim 1, wherein either the upper or lower phase of the coagulation bath has a coagulation value of more than 30 and the other has a coagulation value of below 10.

11. A process according to claim 1, wherein the said starting solution comprises a polyacrylonitrile, the coagulation bath comprises ethyl acetate (specific gravity: 0.90, coagulation value: 67.8) as the upper phase and water (specific gravity: 1.00, coagulation value: 8.3) as the lower phase.

12. A process according to claim 1, wherein the said starting solution comprises soy bean casein and polyacrylonitrile, the coagulation bath comprises methyl acetate (specific gravity: 0.93, coagulation value: 40.6) as the upper phase and water (specific gravity: 1.00, coagulation value: 6.2) as the lower phase.

13. A process according to claim 1, wherein the said starting solution comprises a polyurethane, the coagulation bath comprises p-xylene (specific gravity: 0.86, coagulation value: 56.0) as the upper phase and hydrazine (specific gravity: 1.04, coagulation value: 6.3) as the lower phase.

14. A process according to claim 1, wherein the said starting solution comprises a polyurethane, the coagulation bath comprises kerosene (specific gravity: 0.87, coagulation value: 12.3) as the upper phase and a mixture consisting of equal amounts of water and dimethyl sulfoxide (specific gravity: 0.97, coagulation value: 36.0) as the lower phase.

15. A process according to claim 1, wherein the said starting solution comprises a graft copolymer of yeast protein and a polyurethane, the coagulation bath comprises benzene (specific gravity: 0.88, coagulation value: 60.0) as the upper phase and hydrazine (specific gravity: 1.04, coagulation value: 6.6) as the lower phase.

16. A process according to claim 1, wherein the said starting solution comprises cellulose triacetate, the coagulation bath comprises butyl acetate (specific gravity: 0.88, coagulation value: 37.4) as the upper phase and a mixture of water and isopropyl alcohol (mixing ratio of 7:3 by weight, specific gravity: 0.94, coagulation value: 4.5) as the lower phase.

17. A process according to claim 1, wherein during feeding of the starting solution a shearing force is applied to the interface area at a linear velocity of from 20 centimeters/second to 2 meters/second.

18. A process according to claim 17, wherein said shearing force comprises reciprocal agitation by vibration applied parallel to the interface area of the coagulation bath.

* * * * *